US006127034A

United States Patent [19]

Chorley

[11] Patent Number: 6,127,034

[45] Date of Patent: Oct. 3, 2000

[54] SECURITY DOCUMENTS

[75] Inventor: Brian Chorley, Buckhurst Hill, United Kingdom

[73] Assignee: Governor and Company of the Bank of England, London, United Kingdom

[21] Appl. No.: 09/308,108

[22] PCT Filed: Sep. 19, 1997

[86] PCT No.: PCT/GB97/02563

§ 371 Date: Jul. 1, 1999

§ 102(e) Date: Jul. 1, 1999

[87] PCT Pub. No.: WO98/19866

PCT Pub. Date: May 14, 1998

[30] Foreign Application Priority Data

Nov. 7, 1996 [GB] United Kingdom ..... 9623202
Jan. 29, 1997 [GB] United Kingdom ..... 9701767

[51] Int. Cl.[7] ..... D02G 3/00

[52] U.S. Cl. ..... 428/375; 118/46; 118/58; 118/419; 427/7; 427/130; 427/131; 427/132; 427/261; 427/264; 427/265; 427/270; 427/271; 427/289; 427/354; 427/385.5; 427/404; 427/407.1; 428/458; 428/693; 428/694 R; 428/694 TP; 428/900

[58] Field of Search ..... 427/7, 131, 130, 427/132, 261, 264, 265, 270, 271, 289, 354, 404, 385.5, 407.1; 118/46, 58, 419; 428/375, 458, 693, 694 R, 694 TP, 900

[56] References Cited

U.S. PATENT DOCUMENTS

| | | | |
|---|---|---|---|
| 4,925,215 | 5/1990 | Klaiber | 283/82 |
| 4,941,687 | 7/1990 | Crane | 283/91 |
| 5,516,153 | 5/1996 | Kaule | 283/85 |

FOREIGN PATENT DOCUMENTS

| | | |
|---|---|---|
| 0 330 733 | 9/1989 | European Pat. Off. . |
| 0 536 855 | 4/1993 | European Pat. Off. . |
| 2 250 474 | 6/1992 | United Kingdom . |

*Primary Examiner*—Bernard Pianalto
*Attorney, Agent, or Firm*—Lee, Mann, Smith, McWilliams, Sweeney & Ohlson

[57] ABSTRACT

A method of manufacturing a composite security thread, e.g. for a bank note, is produced by coating aluminium film onto a polyester film and coating selected regions with magnetic material. Photoresist characters are next printed onto the magnetic material, and a chemical applied to remove the aluminium coating except where protected by the resist. An obscuring silver coating is then applied over the magnetic material, and a final transparent material applied as a barrier to reduce the risk of damage during subsequent processing.

13 Claims, 2 Drawing Sheets

SECURITY DOCUMENTS

FIELD OF THE INVENTION

This invention concerns the production of paper or other sheet material for such security documents, and in particular the production of security thread such as described in UK Patent Specification 2227451, which is inserted into such paper/sheet material.

BACKGROUND TO THE INVENTION

The insertion of a security thread into security document paper such as that used for printing bank notes is known. Such threads are typically in the form of an elongate strip typically formed from a plastics film, one surface of which is itself coated with a thin metallic film, and sandwiched between the metal film and the plastics film are regions of magnetic material which are spaced apart and are of such a length (measured in the length direction of the thread), that when moved relative to a suitable electromagnetic reading head, can induce electrical signals having characteristics which can be de-coded to determine the pattern of magnetic material in the security thread.

It has also been proposed to incorporate symbols, letters, numerals or other visually decipherable or machine readable data along the length of the thread and to arrange that this visually and/or machine readable material can be identified at least on one side of the thread and can be inspected (visually or by machine reading) when the thread is incorporated in a security document or bank note.

In particular the readable data may comprise a short description of the document within which the thread is incorporated, and in the case of a bank note may be the currency and denomination of the note.

In U.S. Pat. No. 5,516,153 there is described a security thread in which a plastic carrier is coated with a metal layer to form recessed characters on which is overprinted bars of magnetic ink. Alternatively a thin layer of magnetic pigment may be applied all over the metal layer. Reference is also made therein to EP-A-0330733 which discloses a security thread having a substrate carrier layer made of a tear-resistant material such as polyester.

Security threads are also described in EP Specifications 0400902, 0426801, 0498186, 0659587 and 0613786.

It is an object of the present invention to supply a method and apparatus for producing a preferred form of a composite security thread ie. one having a metallic film for electrical continuity, magnetic encoding to allow the thread to be read using a magnetic reader, and bearing visible data or markings which can be seen by the naked eye.

SUMMARY OF THE INVENTION

According to one aspect of the present invention there is provided a method of manufacturing a composite security thread comprising the steps of:

a) coating a polyester film with metal layer typically aluminium;

b) coating selected regions of the film with magnetic material so as to produce spaced apart groups of regions along the length of the film which can be detected by a magnetic reading head, to generate electrical readings for decoding;

c) in registry with selected groups of the magnetic material, printing characters which are to appear visible to the naked eye along a parallel region of the laminated film using a photo resist material so as to protect the metal layer in those regions in which the characters are to appear in the final thread;

d) applying a chemical to the said parallel region to remove the metal layer except where protected by the resist;

e) coating the region containing the groups of spaced apart magnetic material with an obscuring layer;

f) coating the entire surface of the film containing the magnetic depositions and the visually readable characters with a transparent or semi-transparent material to provide a barrier to prevent chemical contamination and provide physical protection to the magnetic regions and the visually readable characters, to reduce the risk of damage to the film during the subsequent paper making and printing processes to which the film is subjected.

In an alternative arrangement the aluminium is coated with resist except where the characters are to be formed, and the unprotected aluminium is removed by chemical treatment so that the letters are seen as transparent regions in the opaque reflective aluminium surface.

The plastics film may be a polyester film typically that marketed under the Trade Mark MYLAR.

The resist is preferably applied by a printing process such as flexo printing, rotagravure or silk screening.

Registration between lines of magnetically readable regions and visually readable characters is important for two reasons. On the one hand the resulting security thread is typically of the order of 3 mm wide and it is important that the spaced apart magnetic regions occupy only that part of the width of the thread allocated to the magnetic readable material, and the visually readable characters only occupy the remaining part of the width of the thread. Additionally however it is desirable that at least one complete set of spaced apart magnetic regions is contained along the length of each region of the thread which will extend across a security document such as a bank note, after the latter has been guillotined from a larger sheet, and it may also be desirable that at least one complete set of visually readable characters making up a message or notification will also appear in each said length of security thread as it extends across the guillotined document.

If this last feature is to be attained, it is important that the magnetically readable regions register in a lengthwise sense with the visually readable characters, and that the length and frequency of repetition of both, along the length of the thread, is such that at least a complete set of visually readable characters and at least a complete set of magnetically readable region will be guaranteed to exist within the dimension of the document across which the thread extends after guillotining.

One method of achieving this is to ensure that the lengthwise extent of the visually readable characters is preferably similar to the lengthwise extent of each group of encoded spaced apart magnetic regions and registers laterally therewith, and the spacing and repetition of the magnetically deposited regions is chosen so that the dimension of each guillotined security document, (such as a bank note), will be such as to contain at least two complete lengths of magnetically readable regions. In this way, however the regions register with the guillotining, there will always be at least one complete set of spaced magnetic regions along the length of the thread which extends across each guillotined document, and therefore likewise at least one complete set of visually readable characters.

The protective coating may be a clear polyester, a semi-transparent polyester or a lacquer.

The protective covering may be applied by a simple coating or printing process or may be applied as a film of polyester or like material which is laminated to the first mentioned film with the printed and coated surface of the first film sandwiched between it and the protective film.

According to another aspect of the invention there is provided a method of manufacturing a security thread comprising the steps of:

a) coating a thin metal layer onto a thin plastics film, typically aluminium onto a polyester film;

b) coating the metallised surface with a resist material except in those regions corresponding to regions which are to form visually readable characters;

c) de-metallising the film by exposing it to a suitable chemical so as to remove the metal layer from those regions which are to form the visually readable characters;

d) removing surplus chemical by washing;

e) drying the film to remove all traces of chemical and wash;

f) printing onto the metal layer surface, parallel to the lines of visually readable characters, discrete and separated regions of magnetic material, the said regions being arranged in groups to assist in decoding, and the positions of the said groups being selected so as to be in correct registration with the groups of visually readable characters, so that after guillotining a security document containing a length of thread will always include along the guillotined length of thread at least one complete group of visually readable characters and at least one complete group of magnetically readable regions, g) print coating the film so as to obscure the magnetic material; and h) print coating or laminating a protective layer over the original plastics film so as to form a transparent protective coating thereover.

Whichever method is used, the original or primary plastics film is typically of MYLAR, in the range 6–15 microns thick. The flashed metal coating typically has a thickness of a few hundred Angstroms and the magnetic material is applied as rectangular patches approximately 12 microns thick and typically 2 mm in length (ie parallel to the length direction of the thread) and having a width (perpendicularly the length direction of the thread) in the range 0.75 to 1.5 mm.

A finished thread is typically of the order of 3 mm wide and since the magnetic regions can occupy up to 1.5 mm from one edge of the finished thread, a region of approximately 1.5 mm width is available to contain the visually readable characters in the other half of the finished thread.

Where the threads are formed by printing and coating onto rolls of polyester film, it will be seen that the latter is nominally 300 mm wide, approximately 100 threads can be formed by slitting the 300 mm wide film into adjacent 3 mm widths.

According to a further aspect of the invention there is provided apparatus for forming security threads comprising:

a) means for supporting a roll of polyester film, one surface of which is coated with metal such as aluminium;

b) printing apparatus for negatively printing characters in lines equally spaced across width of the film, onto the metallised surface thereof, by coating the surface with a resist material except in the regions where characters are to appear in the finished product;

c) an etching bath containing a liquid chemical through which the film is passed so as to etch away the exposed metallisation;

d) a wash station through which the etched film is passed to remove surplus etching material, and if desired also the resist material;

e) a drying station for evaporatively drying any liquid remaining on the film;

f) a printing apparatus for depositing the so-called code blocks of magnetic material in lines parallel to the lines of etched characters and spaced therefrom, one line of code blocks being provided between each line of characters;

g) printing means for applying a coating of non-magnetic opaque material to the lines of magnetic code blocks to visually obscure the blocks;

h) lamination apparatus for laminating a second polyester film to the first film with the etched characters and code blocks sandwiched between the two polyester films or coating apparatus for coating a lacquer or other plastics material onto the surface of the original film containing the characters and code block, so as to form a protective layer thereover;

i) slitting means for cutting the film into a large number of parallel equal width strips each containing a line of characters and a parallel line of magnetic code blocks; and j) wind up means for separately receiving and winding up each of the threads formed by the slitting means.

The material used for laminating or coating the original polyester film to form the protective layer thereon is preferably transparent so that the etched regions of the metallised film defining the characters can be seen therethrough.

In order to better accommodate the thickness of the magnetic material, the basic polyester film may be indented using an indenting roller prior to the application of the magnetic material and the application of the latter is controlled in strict registry with the indentations so that the magnetic material is applied to the indentations rather than the surrounding surface of the material. If 12 micron film is employed and 6 micron indents are formed, and a magnetic material is printed onto the indents so as to be some 12 microns thick from the base of the indent, each magnetic region will extend approximately 6 mm proud of the surface of the film. If a protective film of lacquer is applied and the composite film is squeezed so that the maximum thickness of lacquer and basic film is nominally 24 microns, there will be approximately 6 microns of lacquer above the surface of each magnetic region and 6 microns of polyester below each set magnetic region.

If in preference, two layers of polyester film are laminated so as to form a composite thread, the second film is preferably similarly indented using an indenting roller in strict registration with the indents on the lower film and during lamination the indents in the second film are aligned with the magnetic regions on the lower polyester film so that the composite thread presents two parallel smooth polyester surfaces top and bottom and approximately 6 microns of polyester film exist above and below each magnetic region.

In this way the overall thickness of the thread can be reduced to approximately 25 microns without any reduction in strength.

The invention also lies in security thread material having coated thereon a protective layer of at least a semi-transparent material and in accordance with any of the aforementioned methods.

The invention also lies in security paper containing security thread having coated thereon a protective layer of at least a semi-transparent material and constructed in accordance with any of the aforementioned methods.

The invention also lies in bank notes containing security thread having coated thereon a protective layer of at least a semi-transparent material and constructed in accordance with any of the aforementioned methods.

In order to provide proper protection and good support strength, the basic plastics film needs to be somewhere in the range of 6 to 15 microns and the protective layer or second laminated film needs to be of a similar thickness. In order to be effective it has been found that some 12 to 13 microns of magnetic material must be deposited. Any lesser thickness of such material means that its magnetic properties are insufficient for reliable magnetic reading.

This means that the overall thickness of the thread tends to be governed by the thickness of the magnetic material as much as anything else, since it can account for 50% of the thickness of the overall sandwich if 6 micron thick film is employed above and below the magnetic material.

BRIEF DESCRIPTION OF THE DRAWINGS

The invention will now be described by way of example, with reference to the accompanying drawings, in which.

DETAILED DESCRIPTION

Figure 1:
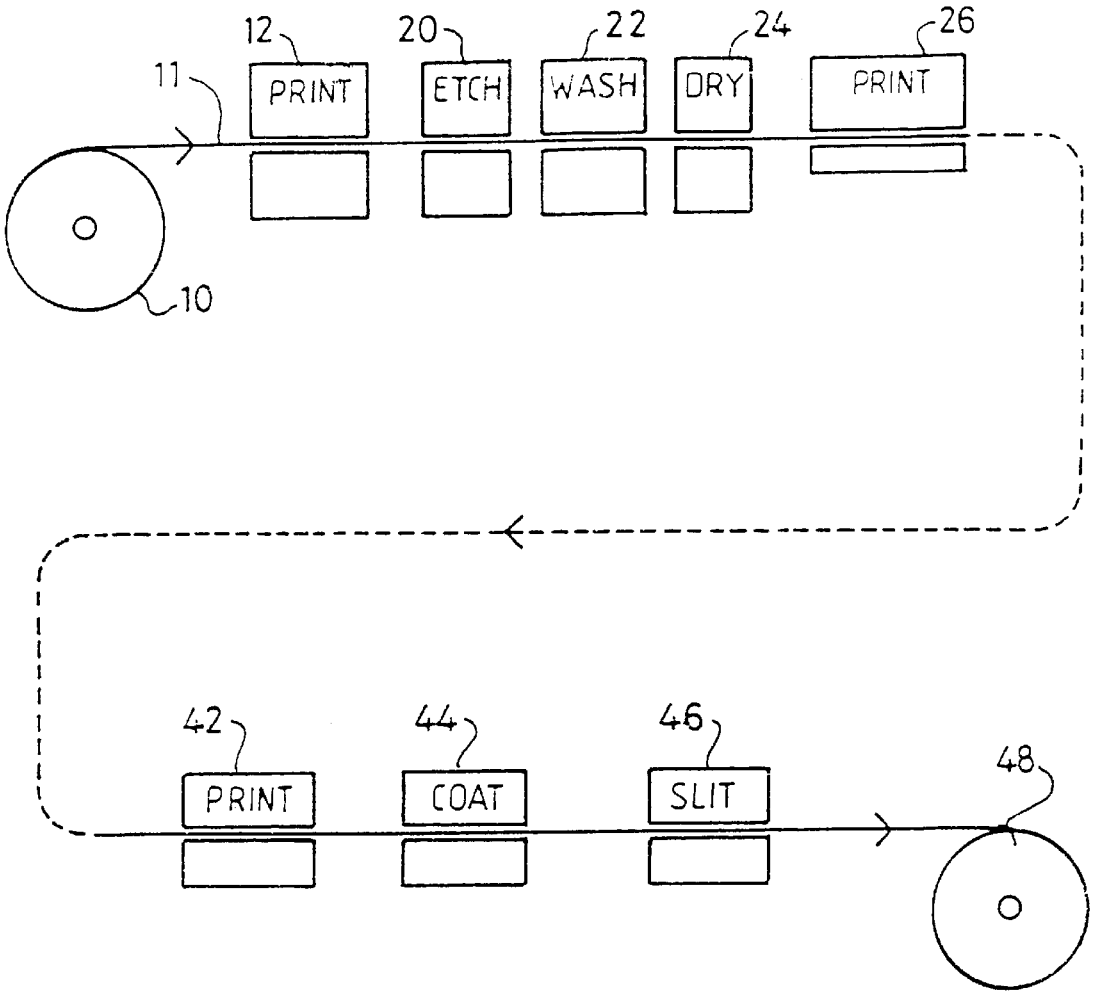
FIG. 1 is a schematic drawing of a printing and processing line for producing thread in accordance with one aspect of the invention.
Figure 1A:
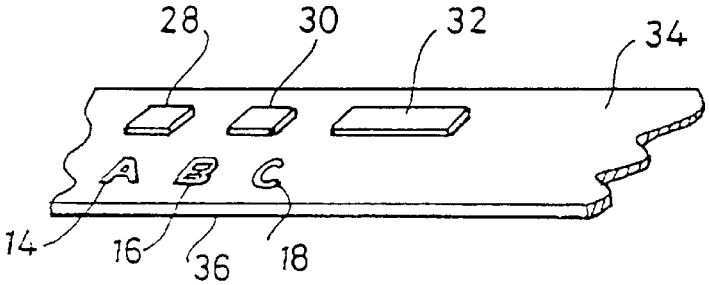
FIGS. 1A and 1B illustrate two alternative ways of printing the magnetic patches.

In FIG. 1 a roll of aluminised Mylar (Trade Mark) 10 supplies film 11 in the range 6–15 microns thick (typically 8 microns), to a printing press 12 for gravure printing of letters in negative, along the length of the film as at 14, 16, 18 in FIG. 1A.

The finished thread is only 3 mm wide, and to facilitate handling and speed-up production, 100 such threads are formed across a 300 mm wide film of Nylon. The roll 10 is thus 300 mm wide and will typically be some hundreds of meters long. For simplicity, all 100 spaced apart lines of letters such as 14, 16 18 are printed across the width of the film 11 simultaneously, by the printing state 12.

The printing stage 12 uses a resist ink, so that after passing through an etching bath 20, the aluminium is removed to form "stencil" letters such as A, B, C in FIG. 1A. After washing in 22 and drying in 24, the aluminised film is again printed in printing stage 26 so as to deposit in parallel to the lines of characters 14, 16, 18, lines of "patches" such as 28, 30, 32 (see FIG. 1A) of magnetic ink.

The patches are printed onto the aluminium coated surface 34 of the film 11. The Mylar substrate is identified by reference numeral 36. Typically the aluminium flashing is a few hundred Angstroms thick, and in order to provide sufficient magnetic material in each patch, the latter are typically 12–13 microns thick and typically 2 mm long by approximately 1 mm wide.

In the same way as the lines of letters, the 100 spaced apart lines of patches are also printed simultaneously across the width of the film 11.

The black patches 28, 30, 32 etc are obscured by printing a continuous ribbon of silver or silver coloured ink over each line of patches, by printing stage 42.

A protective coating of plastics material is applied by a coater (or laminator) 44, so as to wholly encapsulate the printing between the Mylar substrate 36 and a film applied by the coater 44. The 300 mm wide sheet is then slit lengthwise by a slitter 46, into 100 parallel threads, which can be wound up on separate bobbins, at 48.

Figure 1B:
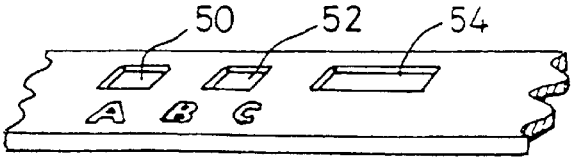

In order to reduce the overall thickness, and also produce a smooth upper surface, the printing of the patches 28 etc may be such as to impress the magnetic ink into the thickness of the Mylar substrate 36 (or the printing may be preceded by an embosser or indenter (not shown) which may be incorporated in the printer 26), and the magnetic ink may be applied so as to fill up the indents. This is shown in FIG. 1B—in which for clarity the indented regions which are to be filled with magnetic ink, are shown empty at 50, 52 and 54.

Figure 2:
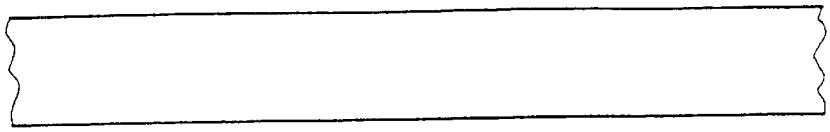
FIGS. 2 to 6 illustrate the different steps of the printing and processing method of FIG. 1.
Figure 3:
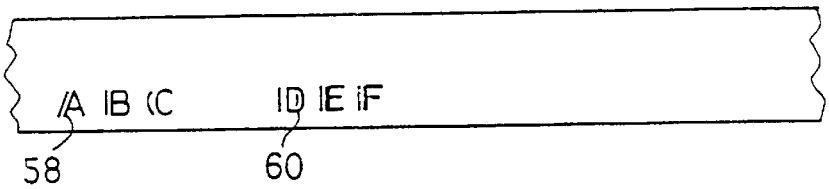

FIG. 2 shows a 3 mm wide strip of Mylar 56 having a thin flashed coating of Aluminium on the upper surface. In practice this 3 mm strip would be part of a wider sheet (typically 300 mm wide), and only after all the printing and processing would it be slit into the narrow 3 mm widths shown in FIG. 2.

After negative letter printing with resist, etching, washing and drying, a line of lettering such as ABC etc at 58, 60, appears along each 3 mm strip, the letters being formed by the etching away of the aluminium.

Figure 4:
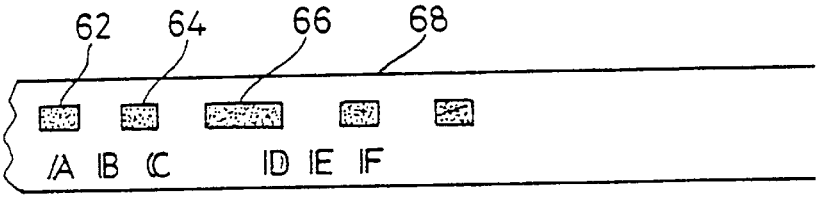

FIG. 4 shows the next step namely the addition of parallel lines of spaced apart patches of black magnetic ink, one of which is shown at 62, 64, 66 etc, spaced from an adjacent line of letters 58, 60; and also from what will be the edge of the thread 68, after the sheet has been slit.

Figure 5:
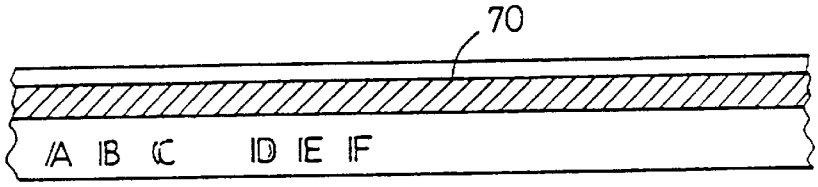

FIG. 5 shows how the black patches are obscured by printing along the line of patches a Silver or Silver coloured ink line 70.

Figure 6:
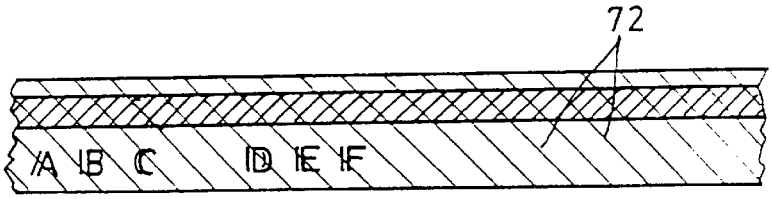

FIG. 6 shows the application of a final protective coating of clear plastics material. This may be coated in liquid form or applied as a film and laminated under heat and pressure. This is designated by the left to right hatching 72 in FIG. 6.

Figure 7:
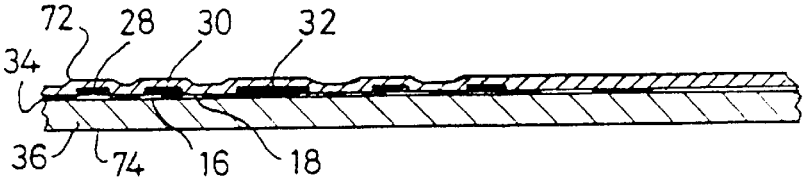
FIG. 7 shows in section the end product if the patches are printed so as to be proud of the substrate surface.

FIG. 7 shows the end product in cross-section where the magnetic ink patches have been applied to a flat aluminised Mylar surface, without sufficient pressure to cause the patches to become embedded in the thickness of the Mylar substrate.

Figure 8:
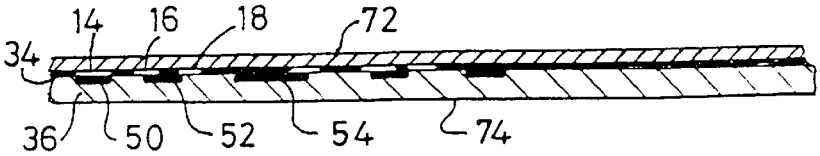
FIG. 8 shows in section the end product if the patches are impressed into the substrate.

FIG. 8 shows the more advantageous result if the magnetic ink occupies wells formed in the Mylar by embossing/indenting the Mylar before, or during, or after, printing in 26 in FIG. 1. Here the upper surface of 72 is equally as flat as the underside 74 of the substrate 36.

What is claimed is:

1. A method of manufacturing a composite security thread comprising the steps of:

a) coating a plastics film with an aluminium film to form a laminated film;

b) coating selected regions of the aluminium film with magnetic material so as to produce spaced apart groups of regions along the length of the aluminium film which can be detected by a magnetic reading head, to generate electrical readings for decoding;

c) in registry with selected groups of the magnetic material, printing characters which are to appear visible to the naked eye along a parallel region of the laminated film using a photo resist material so as to protect the aluminum film in those regions in which the characters are to appear in the final thread;

d) applying a chemical to the said parallel region to remove the aluminium film except where protected by the resist material;

e) coating the region containing the groups of spaced apart magnetic material with an obscuring layer; and f) coating the entire surface of the laminated film containing the magnetic depositions and the visually readable characters with a transparent or semitransparent material to provide a barrier to prevent chemical contamination and provide physical protection to the magnetic regions and the visually readable characters, to reduce the risk of damage to the laminated film during the subsequent paper making and printing processes to which the laminated film is subjected.

2. A method according to claim 1 in which in place of step c) the metal layer is coated with resist except where the characters are to be formed, and the unprotected metal layer is removed by chemical treatment so that the letters are seen as transparent regions in the opaque reflective metal layer surface.

3. A method according to claim 1 in which the plastics film is a polyester film.

4. A method according to claim 1 in which the resist is applied by a printing process such as flexo printing, rotagravure or silk screening.

5. A method according to claim 1 in which the lengthwise extent of the visually readable characters is similar to the lengthwise extent of each group of encoded spaced apart magnetic regions and registers laterally therewith, and the spacing and repetition of the magnetically deposited regions is chosen so that the dimension of each guillotined security document, such as a bank note, will be such as to contain at least two complete lengths of magnetically readable regions.

6. A method according to claim 1 in which the final protective coating is a clear polyester, a semi-transparent polyester or a lacquer.

7. A method according to claim 6 in which the protective coating is applied by a simple coating or printing process or applied as a film of polyester or like material which is laminated to the first mentioned film with the printed and coated surface of the first film sandwiched between it and the protective film.

8. A security thread material having coated thereon a protective layer of at least a semi-transparent material and constructed in accordance with claim 1.

9. Security paper containing security thread having coated thereon a protective layer of at least a semi-transparent material and constructed in accordance with claim 1.

10. Bank notes containing security thread having coated thereon a protective layer of at least a semi-transparent material and constructed in accordance with claim 1.

11. A method of manufacturing a security thread comprising the steps of:

a) coating a thin metal layer of aluminium film onto a thin plastics film;

b) coating the aluminised surface with a resist material except in those regions corresponding to regions which are to form a line of visually readable characters;

c) de-metallising the film by exposing it to a suitable chemical so as to remove the metal layer from those regions which are to form the line of visually readable characters;

d) removing surplus chemical by washing;

e) drying the film to remove all traces of chemical and wash;

f) printing onto the metal layer surface, parallel to the line of visually readable characters, discrete and separated regions of magnetic material, the said regions being arranged in groups to assist in decoding, and the positions of the said groups being selected so as to be in correct registration with the groups of visually readable characters, so that after guillotining a security document containing a length of thread will always include along the guillotined length of thread at least one complete group of visually readable characters and at least one complete group of magnetically readable regions;

g) print coating the film so as to obscure the magnetic material; and h) print coating or laminating a protective layer over the original plastics film so as to form a transparent protective coating thereover.

12. Apparatus for forming security threads comprising:

a) means for supporting a roll of polyester film, one surface of which is coated with aluminium;

b) printing apparatus for negatively printing characters in lines equally spaced across the width of the film, onto the aluminised surface thereof, by coating the surface with a resist material except in the regions where characters are to appear in the finished product;

c) an etching bath containing a liquid chemical through which the film is passed so as to etch away the exposed aluminum;

d) a wash station through which the etched film is passed to remove surplus etching material, and if desired also the resist material;

e) a drying station for evaporatively drying any liquid remaining on the film;

f) a printing apparatus for depositing code blocks of magnetic material in lines parallel to the lines of etched characters and spaced therefrom, one line of code blocks being provided between each line of characters;

g) printing means for applying a coating of nonmagnetic opaque material to the lines of magnetic code blocks to visually obscure the blocks;

h) lamination apparatus for laminating a second polyester film to the first film with the etched characters and code blocks sandwiched between the two polyester films or coating apparatus for coating a lacquer or other plastics material onto the surface of the original film containing the characters and code block, so as to form a protective layer thereover;

i) slitting means for cutting the film into a large number of parallel equal width strips each containing a line of characters and a parallel line of magnetic code blocks; and j) wind up means for separately receiving and winding up each of the threads formed by the slitting means.

13. Apparatus according to claim 12 further comprising means for indenting the first polyester film using an indenting roller prior to the application of the magnetic material, and means for controlling the application of the latter in strict registry with the indentations so that the magnetic material is applied to the indentations rather than the surrounding surface of the material.

* * * * *